United States Patent [19]

Kamisada

[11] Patent Number: 4,778,964

[45] Date of Patent: Oct. 18, 1988

[54] SUBMINIATURE SWITCH WITH COMMON AND STATIONARY SWITCHING CONTACTS

[75] Inventor: Koji Kamisada, Tokyo, Japan

[73] Assignee: Nihon Kaiheiki Industrial Company Ltd., Tokyo, Japan

[21] Appl. No.: 57,654

[22] Filed: Jun. 8, 1987

Related U.S. Application Data

[63] Continuation-in-part of Ser. No. 826,035, Feb. 4, 1986, abandoned.

[30] Foreign Application Priority Data

Sep. 26, 1985 [JP] Japan ..... 60-145787[U]

[51] Int. Cl.[4] ..... H01H 21/12; H01H 21/30

[52] U.S. Cl. ..... 200/284; 200/339; 200/275; 200/68.1; 200/254; 200/282; 200/16 F

[58] Field of Search ..... 200/275, 284, 271, 272, 200/153 J, 153 I, 16 R, 16 F, 6 B, 6 R, 292, 293, 68.1, 68.2, 254–256, 282, 339, 340

[56] References Cited

U.S. PATENT DOCUMENTS

| | | | |
|---|---|---|---|
| 3,146,330 | 8/1964 | Miller | 200/339 |
| 3,259,728 | 7/1966 | De Rougemont et al. | 200/284 X |
| 3,403,237 | 9/1968 | Wysong | 200/339 |
| 3,437,772 | 4/1969 | Piber | 200/284 |
| 3,641,291 | 2/1972 | Carling | 200/68.2 |
| 3,683,144 | 8/1972 | Bowen et al. | 200/275 X |
| 3,735,077 | 5/1973 | Ohashi | 200/315 |
| 3,988,558 | 10/1976 | Tosemans et al. | 200/375 |
| 3,996,431 | 12/1976 | Brown | 200/16 C |
| 4,013,857 | 3/1977 | Tamaka | 200/315 |
| 4,016,377 | 4/1977 | Iwasaki | 200/16 F |
| 4,123,634 | 10/1978 | Hults | 200/339 X |
| 4,149,049 | 4/1979 | Long | 200/339 X |
| 4,162,386 | 7/1979 | Bourgeois et al. | 200/339 |
| 4,371,767 | 2/1983 | Ohashi et al. | 200/335 |
| 4,389,549 | 6/1983 | Brown | 200/5 R |
| 4,433,222 | 2/1984 | Kodaira | 200/153 J |
| 4,463,233 | 7/1984 | Tanabe | 200/340 |
| 4,644,110 | 2/1987 | Watanabe et al. | 200/68 X |

FOREIGN PATENT DOCUMENTS

| | | | |
|---|---|---|---|
| 1076971 | 2/1984 | U.S.S.R. | 200/284 |

*Primary Examiner*—Henry J. Recla
*Assistant Examiner*—Ernest G. Cusick
*Attorney, Agent, or Firm*—Armstrong, Nikaido, Marmelstein & Kubovcik

[57] ABSTRACT

A subminiature switch includes a housing having a base portion in the central part of which is implanted a common stationary contact comprising a rod-shaped conductor and having a common stationary terminal extending outside the housing. Implanted in the base portion on both sides of the common stationary contact are switching stationary contacts each comprising a rod-shaped conductor bent at two locations and having a switching stationary terminal extending outside the housing. The arrangement is such that the inter-terminal spacing outside the housing is greater than the inter-contact spacing inside the housing, thus making it possible to reduce the size of the switch housing and adapt the switch to various mounting structures.

14 Claims, 3 Drawing Sheets

SUBMINIATURE SWITCH WITH COMMON AND STATIONARY SWITCHING CONTACTS

This application is a continuation-in-part of application Ser. No. 826,035 filed Feb. 4, 1986, abandoned.

BACKGROUND OF THE INVENTION

This invention relates to a subminiature switch and, more particularly, to a subminiature switch reduced in size by altering the shape of a stationary contact having a terminal.

Conventional miniature switches have structures of the type shown in FIGS. 1 and 2. The conventional miniature switch shown in partial cross section in FIG. 1 includes an open-topped housing 1 covered by a cover 3 having an upwardly extending bushing 2. A toggle lever 4 is pivotally mounted in the bushing 2 and extends into the interior of the housing 1. A plunger 5 is arranged at the lower end of the toggle lever 4 inside the housing 1. A movable contactor 6 is rockably supported inside the housing 1 on a common contact 8 opposite the plunger 5. The common contact 8 has a common terminal 7. Also disposed inside the housing 1 opposite the movable contactor 6 is a stationary contact 10 having a stationary terminal 9.

The conventional miniature switch illustrated in the perspective view of FIG. 2 includes a switch base 11 covered by a generally U-shaped, open-bottomed housing 13 having an upwardly extending bushing 12. A toggle lever 14 is pivotally mounted in the bushing 12 and extends into the interior of the housing 13. A movable contactor 15 is rockably supported inside the housing 13 on a common contact (not shown) in such a manner as to operate in association with the toggle lever 14. The common contact has a common terminal 16. Also disposed inside the housing 13 opposite the movable contactor 15 is a stationary contact 18 having a stationary terminal 17.

SUMMARY OF THE INVENTION

An object of the present invention is to provide a switch of greatly reduced size achieved by improving upon the structure of a stationary contact of the type implanted in the base of a switch housing and having a terminal at a distal end thereof.

Another object of the present invention is to provide a subminiature switch capable of being readily mounted on any switch mounting structure.

Still another object of the present invention is to provide a subminiature switch in which a terminal implanted in the base of the switch housing is fixedly secured to the base with increased mechanical strength.

According to the present invention, the foregoing objects are attained by providing a subminiature switch having a switch housing which includes a base portion, a common stationary contact implanted in the base portion at a central part thereof and having a common stationary terminal extending outside the base portion, and a switching stationary contact implanted in the base portion alongside the common stationary contact and having a switching stationary terminal extending outside the base portion, the stationary contacts being surrounded by the switching housing. The switching stationary contact is bent at two locations to form two bent portions and is arranged in such a manner that the common stationary terminal and switching stationary terminal outside the housing are spaced apart a distance greater than that between the common stationary contact and switching stationary contact inside the housing.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
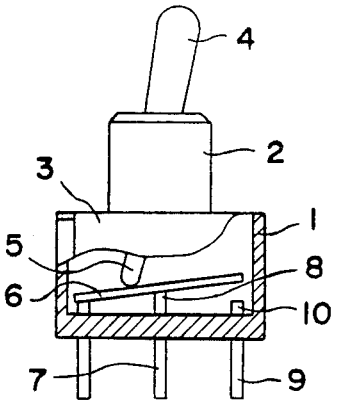
Fig. 1 PRIOR ART
FIG. 1 is a front view, partly in section, illustrating one example of a switch according to the prior art.
Figure 2:
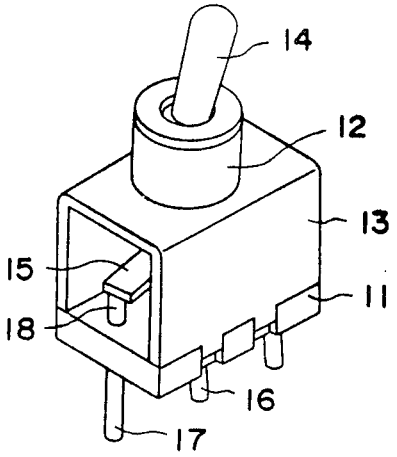
Fig. 2 PRIOR ART
FIG. 2 is a perspective view illustrating another example of a switch according to the prior art.
Figure 3:
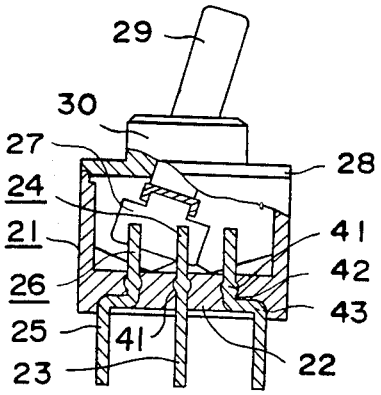
FIG. 3 is a front view, partly in section, illustrating a subminiature switch according to the present invention.
Figure 4:
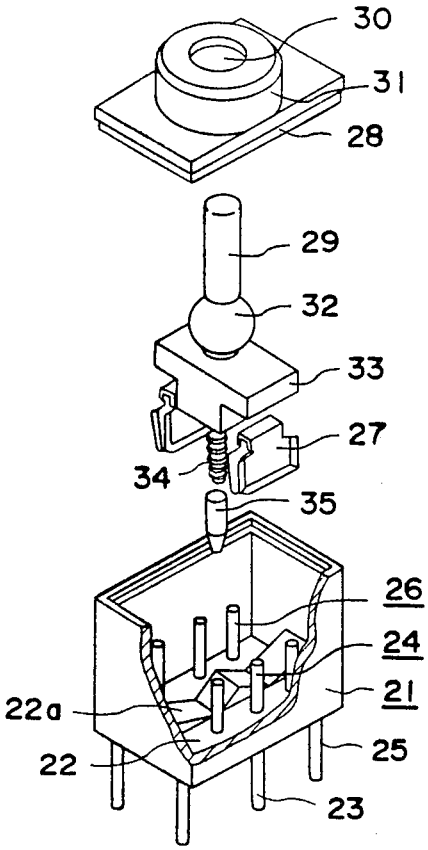
FIG. 4 is an exploded perspective view illustrating the subminiature switch of FIG. 3.
Figure 5:
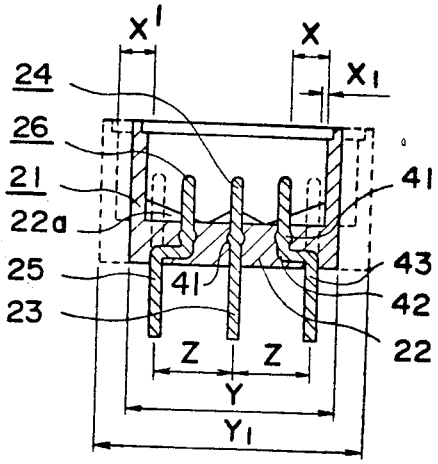
FIG. 5 is a sectional view illustrating a principal portion of the subminiature switch of FIG. 3.

A subminiature switch according to the present invention and illustrated in FIGS. 3 through 5 includes an open-topped housing 21 having a base portion 22. The base portion 22 is provided at its central portion with a common stationary contact 24 extending into the interior of the housing 21 and formed to include a common stationary terminal 23 extending to the outside from below the housing 21. The base portion 22 is also provided with a switching stationary contact 26 on both sides of the common stationary contact 24. The switching stationary contact 26 extends into the interior of the housing 21 and is formed to include a switching stationary terminal 25 extending to the outside from below the housing. The contacts 24, 26 are arranged in a row in such a manner that a movable contactor 27 may bring the common stationary contact 24 into and out of contact with either of the switching stationary contacts 26 on the right and left side, as will be described below. Two identical separate rows of these contacts are provided in the illustrated embodiment, as illustrated in FIG. 4, with the movable contactor 27 being provided for each row. The base portion 22 is provided with a cam surface **22*a* located between these two rows of contacts and formed to include a pair of generally triangular recesses for quick-stop action, one recess being located on each side of the common stationary contact 24. A cover 28 covers the open top of the housing 21, thus constructing a sealed case in combination with the housing 21. The cover 28 is provided with an upwardly extending bushing 31 having a circular bore for receiving a toggle lever 29. The toggle lever 29 comprises a generally spherical portion 32 formed at its lower end inside the housing 21 and serving as the rockable support of the toggle lever, and an acuator block 33 connected to the lower end of the spherical portion 32. The actuator block 33 has a central bore (not shown) the lower end of which receives a plunger 35, with a quick-stop coil spring 34 being interposed between the upper end of the plunger 35 and the closed end of the bore. The movable contactor 27 is attached to actuator block 33 on either side of its central bore and has a clip-like configuration for embracing the contacts 24, 26 in the respective row. The contactor 27** comprises a resilient sheet.

To operate the switch, the toggle lever 29 is rocked back and forth to connect the centrally located common stationary contact 24 to the stationary contact 26 on either the right or left side by means of the movable contactor 27 which is shifted back and forth by the toggle lever 29 while embracing the common stationary contact 24 and either of the stationary contacts 26. When the switch is changed over in this fashion, the plunger 35 is shifted from one triangular recess of the cam surface 22*a* to the other, in the course of which the plunger 35 is raised by a triangular projection between the recesses of the cam surface 22*a*, thereby compressing the coil spring 34 in the bore of actuator block 33. When the plunger 35 begins to enter the other recess of the cam surface 22*a*, the potential energy thus stored in the coil spring 34 is released through the plunger 35, thereby rapidly forcing the plunger 35 downward into this recess along the cam surface 22*a*. Since the movable contactor 27 is attached to the actuator block 33 accommodating the plunger 35, the foregoing operation causes the movable contactor 27 to perform so-called quick-stop movement, in which the movable contactor 27 is moved from one stationary contact 26 to the other and then stopped, all in rapid fashion.

As best seen in FIGS. 3 and 4, the common stationary contact 24 having the common stationary terminal 23 is a linear, rod-shaped conductor having a projection 41 on a portion thereof passing through the base portion 22. The projection 41 functions to prevent the contact 24 from falling out when the housing 21, inclusive of the base portion 22, is molded. The switching stationary contact 26 having the switching stationary terminal 25 comprises a rod-shaped conductor formed to include a first bent portion 42 and a second bent portion 43 in such a manner that the upper end of the stationary contact 26 inside the housing 21 is offset from the lower end outside the housing 21. The portion of the stationary contact 26 passing through the base portion 22 likewise is formed to include the projection 41 to prevent the contact from falling out when the housing 21 is molded. The projection 41, first bent portion 42 and second bent portion 43 of the stationary contact 26 are fixedly secured inside the base portion 22 of the housing 21 when the housing 21 is molded. At the time of such molding, the common stationary contact 24 having the common stationary terminal 23 is a positioned at the approximate center of the base portion 22, and the switching stationary contacts 26 having the stationary terminal 25 are arranged on both sides of the common stationary contact 24. The arrangement is such that the distance between the two stationary terminals 25 outside the housing is greater than the distance between the stationary contacts 26 inside the housing, and such that the distal ends of all of the stationary terminals 23, 25 lie on the same plane, as shown in FIG. 5. It should be noted that each of the rod-shaped conductors forming the contacts may comprise a wire member.

The reasons for adopting the offset configuration of the stationary contact 26 will now be set forth with reference to FIG. 5.

Since all of the rod-shaped conductors used in the conventional switch of this type are of linear configuration, as indicated by the phantom lines in FIG. 5, the isolation spacing is represented by distance Z between each switching stationary terminal 25 and the common stationary terminal 23 is determined by the isolation spacing distance Z between the corresponding terminals. At the same time, it is required that the side wall of the switch housing 21 be spaced away from each of the contacts by a predetermined distance. The reasons for this are (1) to protect the side wall of the switch housing 21 from heat produced by an arc generated when the movable contactor breaks contact with a stationary contact, and (2) to provide enough distance to permit the movable contactor, which possesses a certain width, to fully contact the stationary contactors. Accordingly, when the required spacing X is provided between each contact and the side wall of the housing 21 (X′ being equal to X but being between a phantom contact and the side wall of the housing), the switch housing takes on the shape having an outer diameter $Y_1$, as indicated by the phantom lines in FIG. 5. In accordance with the present invention, however, the switching stationary contacts 26 are constituted by rod-shaped conductors bent into the offset configuration and the contacts 26 are arranged in the manner illustrated. As a result, the spacing between each stationary contact 26 and the common stationary contact 25 is narrower than the spacing or distance Z in the prior-art switch, even though the spacing Z between the corresponding terminals is unchanged. The spacing between each contact 26 and the common contact 25 though reduced is, as a matter of course, selected to afford the necessary isolation between the contacts. Accordingly, if the spacing between the contacts and the inner wall of housing 21 is maintained at the required value X, as made possible by the contact configuration of the present invention, the housing that results has the form shown by the solid lines in FIG. 5, the outer diameter whereof is Y. In other words, the housing can be reduced in outer diameter while still maintaining the required spacing Y. More specifically, if a switch of outer diameter Y were formed using the linear rod-shaped conductors employed in the prior-art switch, the spacing between each stationary contact 26 and the inner wall of the housing 21 would narrow to $X_1$, an unacceptable condition since (1) and (2) above would fail to be satisfied. By using the stationary contact 26 configured in accordance with the present invention, however, the outer diameter of housing 21 can be reduced by an amount equivalent to the amount of the offset between the two ends of the contact conductor. Thus, the size of the switch can be reduced in terms of its outer diameter by a value obtained by subtracting the outer diameter Y of the switch housing according to the present invention from the outer diameter $Y_1$ of the conventional switch housing.

The switch of the present invention, besides being very small, is significant in another respect as well. Specifically, the contact spacing can be set to the required minimum and the terminal spacing can be readily made to conform to any spacing required for mounting, such as the spacing between solder holes in a printed circuit board for mounting the switch. In other words, by adjusting the amount of offset of each of the switching stationary contacts, the spacing between these two contacts can be set at will up to the maximum spacing Y.

Figure 6:
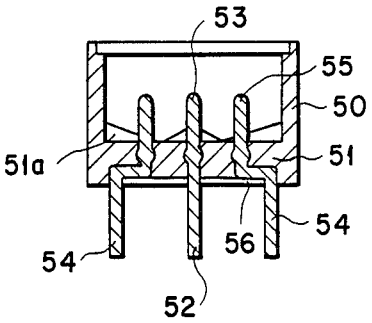
FIG. 6 is an additional embodiment of the present invention.

FIG. 6 shows an additional embodiment for the present invention. FIG. 6 is similar to the previous embodiments and show the following features, including a switch housing 50 having a base portion 51. The base portion 51 is provided at a central portion with a common stationary contact 53 extending into the interior of the housing 50 and formed to include a common stationary terminal 52 extending to the outside from below the housing 50. The base portion 51 is also provided with a switching stationary contact 55 on both sides of the common stationary contact 53. The switching stationary contact 55 extends into the interior of the housing 50 and is formed to include a switching stationary terminal 54 extending to the outside from below the housing. Both the common stationary contact 53 and switching stationary contact 55 are implanted in the base portion. In other words, the contacts 53 and 55 can be implanted by molding into the base portion or can be implanted in the base portion by being press-fitted into a slot formed in the base portion. The base portion includes a fitting recess 56 and has a cam surface 51*a*. When the contacts 53, 55 are implanted in the base portion by molding, the contact spacing can be set to the required minimum, and then the switching stationary terminal bent as shown in FIG. 6. The terminal spacing can be readily made to conform to any spacing required for mounting, such as the spacing between solder holes in a printed circuit board for mounting the switch. When the contacts 53, 55 are implanted in the base portion by being press-fitted into a slot, the switching stationary contact is bent at two locations to form the two bent portions implanted in the slot of the base portion. The fitting recess 56 can then be covered by an insulating adhesive.

It should be noted that the present invention is not limited to the illustrated embodiment described above but can be modified in various ways without departing from the scope of the appended claims.

The advantages of the present invention will now be set forth in detail.

(1) The spacing between mutually adjacent stationary contacts 24, 26 and between each contact and the inner wall of the switch housing 21 can be decided from the viewpoint of providing the dimensions required by the particular design. Moreover, the fact that the terminal spacing can be made different from the contact spacing greatly promotes a reduction in switch size.

(2) The spacing between the terminals 23, 25 of mutually adjacent stationary contacts 24, 26 can be set separately of the spacing between these contacts and, moreover, separately of the spacing between the contacts and the inner wall of the switch housing 21. The spacing between the terminals can thus be made to conform to the conditions required for mounting the switch. This eliminates the need to redesign the mounting hole spacing of the structure, such as a printed circuit board, on which the switch is mounted, as has heretofore been required in the prior art to achieve agreement between the mounting hole spacing and the unalterable terminal spacing of the conventional switch.

(3) Though the movable contactor 27 when manipulated subjects the contact portion of the switching stationary contact 26 to a back-and-forth pressing force while tightly embracing the contact portion, the conductor portion of the switching stationary contact between the first and second bent portions 42, 43 is molded in the base portion 22 of the switch, thereby essentially lengthening the fixed portion of the contact and, hence, reinforcing the mechanical strength at which the contact is secured to the base portion 22. In particular, since it is more difficult to secure a rod-shaped conductor to the base portion in comparison with a plate-shaped conductor, lengthening the portion of the conductor secured to the base portion is especially advantageous. This feature is particularly important in view of the fact that fixedly securing a stationary contact to a switch base portion will become more difficult as switches become smaller in size.

(4) The switch housing 21 surrounds each of the stationary contacts 24, 26 and the overall structure is sealed to assure a water and dust-proof condition. Yet, despite the fact that the stationary contacts are enclosed in the housing 21, the switch can be reduced in size in such a manner as to provide the required inter-contact isolation and meet the required standards.

(5) Since the contact portion and terminal portion of each stationary contact are formed as part of an integrated body, the stationary contacts can be manufactured with facility.

What is claimed is:

1. A subminiature switch comprising:

a switch housing;

a molded base portion having a cam surface for quick stopping action and having a central part;

a common stationary contact surrounded by the switch housing, said common stationary contact being molded into the molded base portion at said central part thereof and having a common stationary terminal extending outside the molded base portion, said common stationary contact being a rod-shaped conductor;

a switching stationary contact surrounded by the switch housing, said switching stationary contact being molded into the molded base portion alongside said common stationary contact and having a switching stationary terminal extending outside the molded base portion, said switching stationary contact being a rod-shaped conductor, said switching stationary contact having a projection fixedly secured in the molded base portion by being molded inside the base portion;

a movable contactor surrounded by the switch housing and movable for bringing said common stationary contact into and out of contact with said switching stationary contact;

said switching stationary contact molded into said molded base portion being bent at two locations inside said molded base portion to form two bent portions inside said molded base portion, said two bent portions being arranged in such a manner that the common stationary terminal and switching stationary terminal are spaced apart a greater distance where said terminals extend outside said molded base portion than between said common stationary contact and said switching stationary contact in said switch housing;

a toggle lever having a lower end, said toggle lever having a spherical portion formed at said lower end, said lower end being located inside said switch housing, said spherical portion serving as a rockable suport of said toggle lever;

an actuator block connected to the lower end of said spherical portion of said toggle lever, said actuator blocking having a a lower end and a closed end;

a plunger being received in the lower end of said actuator block, said plunger having an upper end;

a quick-stop coil spring being interposed between said upper end of said plunger and said closed end of said actuator block;

said movable contactor being attached to said actuator block on at least one side of said actuator block, said movable contactor having a clip-like configuration for embracing said stationary contacts.

2. The subminiature switching according to claim 1, wherein two of said switching stationary contacts are provided, one on each side of said common stationary contact.

3. The subminiature switch according to claim 1, wherein said two bent portions of said switching stationary contact are fixedly secured inside said molded base portion.

4. The subminiature switch according to claim 1, wherein said switching stationary contact is formed that opposite ends thereof in said switch housing and extending outside said base respectively, are offset from each other.

5. A subminiature switch comprising:

a switch housing;

a base portion having a central part and having a cam surface for quick stopping action;

a common stationary contact surrounded by the switch housing, said common stationary contact being implanted in the central part of the base portion and having a common stationary terminal extending outside of the base portion, said common stationary contact being a rod-shaped conductor;

a switching stationary contact surrounded by the switch housing, said switching stationary contact being implanted in the base portion alongside said common stationary contact and having a switching stationary terminal extending outside the base portion, said switching stationary contact being a rod-shaped conductor, said switching stationary contact having a projection fixedly secured in the molded base portion by being molded inside the base portion;

a movable contactor surrounded by the switch housing and movable for bringing said common stationary contact into and out of contact with said switching stationary contact;

said switching stationary contact being bent at two locations to form two bent portions and arranged in such a manner that the common stationary terminal and switch stationary terminal are spaced apart at a greater distance where said terminals extend outside said base portion than between said common stationary contact and switching stationary contact in said switch housing;

a toggle lever having a spherical portion formed at a lower end of said toggle lever, said lower end being located inside said switch housing, said spherical porition serving as a rockable support of said toggle lever;

an actuator block connected to the lower end of said spherical portion of said toggle lever, said actuator block having a lower end and a closed end;

a plunger being received in the lower end of said actuator block, said plunger having an upper end;

a quick-stop coil spring being interposed between said upper end of said plunger and said closed end of said actuator block; and said movable contactor being attached to said actuator block on at least one side of said actuator block, said movable contactor having a clip-like configuration for embracing said stationary contacts.

6. A subminiature switch according to claim 5 wherein two rows of common stationary contacts and switching stationary contacts are formed in the base portion and said cam surface of said base portion is located between the two rows of contacts.

7. A subminiature switch according to claim 5 wherein said two bent portions extend from said projection are adjacent each other inside said base portion with said two bent portions being formed near a bottom of the base portion and the projection being formed closer to the top of the base portion.

8. The subminiature switching according to claim 5, wherein two of said switching stationary contacts are provided, one on each side of said common stationary contact.

9. A subminiature switch comprising:

a switch base housing;

a base portion having a central part and having a cam surface for quick stopping action;

a common stationary contact surrounded by the switch housing, said common stationary contact being molded into the central part of the base portion and having a common stationary terminal extending outside the base portion, said common stationary contact being a rod-shaped conductor;

a switching stationary contact surrounded by the switch housing, said switching stationary contact being molded into the base portion alongside said common stationary contact and having a switching stationary terminal extending outside the base portion, said switching stationary contact being a rod-shaped conductor having a projection on a portion thereof which is inside the base portion, said projection being fixedly secured in the base portion by being molded into the base portion;

a movable contactor surrounded by the switch housing and movable for bringing said common stationary contact into and out of contact with said switching stationary contact;

said switching stationary contact terminal being bent at two locations to form two bent portions and arranged in such a manner that the common stationary terminal and switching stationary terminal are spaced apart a greater distance where said terminals extend outside said base than between said common stationary contact and switching stationary contact in said switch housing;

a toggle lever having a lower end and having a spherical portion formed at the lower end, said lower end being located inside said switch housing, said spherical portion serving as a rockable support of said toggle lever;

an actuator block connected to the lower end of said spherical portion of said toggle lever, said actuator block having a lower end and a closed end;

a plunger being received in the lower end of said actuator block, said plunger being an upper end;

a quick-stop coil spring being interposed between the upper end of said plunger and said closed end of said actuator block; and said movable contactor being attached to said actuator block on at least one side of said actuator block, said movable contactor having a clip-like configuration for embracing said stationary contacts.

10. A subminiature switch according to claim 9 wherein two rows of common stationary contacts and switching stationary contacts are formed in the base portion and said cam surface of said base portion is located between the two rows of contacts.

11. A subminiature switch according to claim 9 wherein said two bent portions extend from said projection are adjacent each other inside said base portion with said two bent portions being formed near a bottom of the base portion and the projection being formed close to the top of the base portion.

12. The subminiature switching according to claim 9, wherein two of said switching stationary contacts are provided, one on each side of said common stationary contact.

13. A subminiature switch having a switch housing which includes a molded base portion, said subminiature switch comprising:

a common stationary contact surrounded by the switch housing molded into the molded base portion at a central part thereof and having a common stationary terminal extending outside the molded base portion, said common stationary contact being a rod-shaped conductor;

a switching stationary contact surrounded by the switch housing molded into the molded base portion alongside said common stationary contact and having a switching stationary terminal extending outside the molded base portion, said switching stationary contact being a rod-shaped conductor; and a movable contactor surrounded by the switch housing and movable for bringing said common stationary contact into and out of contact with said switching stationary contact;

said switching stationary contact molded into said molded base portion being bent at two locations inside said molded base portion to form two bent portions inside said molded base portion, said two bent portions being arranged in such a manner that the common stationary terminal and switching stationary terminal are spaced apart a greater distance where said terminal extends outside said molded base portion than between said common stationary contact and said switching stationary contact in said switch housing, each of said switching stationary contacts having walls and having a rounded projection on the walls of each said contacts, said rounded projection being fixedly molded near a mid-point of a depth of said molded base portion.

14. subminiature switch comprising:

a switching housing having a base portion;

a common stationary contact surrounded by the switch housing, the common stationary contact having a portion molded into a central part of the base portion, having a portion extending inside the switch housing and having a common stationary terminal extending outside the base portion, said common stationary contact being a rod-shaped conductor;

a switching stationary contact surrounded by the switch housing, the switching stationary contact having a portion molded into the base portion alongside the common stationary contact, having a portion extending inside the switch housing and having a switching stationary terminal extending outside the base portion, said switching stationary contact being a rod-shaped conductor having a projection on the portion which is molded into the base portion, said switching stationary contact being bent at two locations to form to two bent portions on the portion which is molded inside the base portion, the two bent portions being located between said projection and said switching stationary terminal which extends outside said base portion, said two bent portions being arranged so that the common stationary terminal and switching stationary terminal are spaced apart a greater distance where said terminals extend outside said base portion than between said common stationary contact and said switching stationary contact in said switch housing;

a movable contactor surrounded by the switch housing, said movable contactor being movable for being said common stationary contact into and out of contact with said switching stationary contact.

* * * * *